US005719478A

United States Patent [19]

Washio et al.

[11] Patent Number: 5,719,478

[45] Date of Patent: Feb. 17, 1998

[54] METHOD AND SYSTEM FOR BUNCHING A NON-RELATIVISTIC CHARGED PARTICLE BEAM HAVING A KINETIC ENERGY OF 1 EV TO 1 MEV USING AN ELECTRIC FIELD

[75] Inventors: Masakazu Washio, Yokohama; Masafumi Hirose, Hiratsuka, both of Japan

[73] Assignee: Sumitomo Heavy Industries, Ltd., Tokyo, Japan

[21] Appl. No.: 571,720

[22] Filed: Dec. 13, 1995

[30] Foreign Application Priority Data

Dec. 15, 1994 [JP] Japan ..... 6-312131

[51] Int. Cl.[6] ..... H05H 7/00

[52] U.S. Cl. ..... 315/500; 315/505; 315/506

[58] Field of Search ..... 315/500, 501, 315/503, 504, 505, 506, 4, 5, 5.41, 5.42, 5.43, 5.49; 313/361.1

[56] References Cited

PUBLICATIONS

Book entitled "Principles of Charged Particle Acceleration"by Stanley Humphries, Jr., Published by John Wiley & Sons, New York, New York, Chapter 10 Linear Induction Accelerators title page, preface and table of contents (pp. Vii–Xiii); and pp. 283–317, published 1986.

T. Mikado et al; "Pulsing System of Slow Positrons at the Electrotechnical Laboratory"; pp. 3–11; vol. 18, No. 2.

D. Schodlbauer et al; "A Pulsing System for Low Energy Positrons"; Apr. 1988; pp. 258–268; Nuclear Instruments and Methods in Physics Research.

*Primary Examiner*—Ashok Patel

*Assistant Examiner*—Jay M. Patidar

*Attorney, Agent, or Firm*—Frishauf, Holtz, Goodman, Langer & Chick

[57] ABSTRACT

A method of bunching a charged particle beam including the step of generating an electric field during a certain time duration, the electric field being generally parallel to a travelling direction of the charged particle beam having a kinetic energy of 1 eV to 1 MeV, and an intensity of the electric field changing as a quadratic function of time. In addition to the waveform changing as the quadratic function, a waveform changing linearly may also be used. The linearly changing waveform may be superposed upon a waveform of a half period from phase $\pi$ to $2\pi$ of a sine wave if the linearly changing waveform monotonously increases, or upon a waveform of a half period from phase 0 to $\pi$ of a sine wave if the linearly changing waveform monotonously decreases. Furthermore, the linearly changing waveform and the sine waveform may be superposed upon a waveform of a half period from phase 0 to $\pi$ of a cosine wave if the linearly changing waveform monotonously increases, or upon a waveform of a half period from phase $\pi$ to $2\pi$ of a cosine wave if the linearly changing waveform monotonously decreases. The charged particle beam having a non-relativistic energy can be shaped into an ultra short pulse.

23 Claims, 6 Drawing Sheets

METHOD AND SYSTEM FOR BUNCHING A NON-RELATIVISTIC CHARGED PARTICLE BEAM HAVING A KINETIC ENERGY OF 1 EV TO 1 MEV USING AN ELECTRIC FIELD

BACKGROUND OF THE INVENTION a) Field of the Invention

The present invention relates to a method of bunching a charged particle beam, and more particularly to a method of bunching a charged particle beam having a non-relativistic energy.

Precise analysis of a substance which cannot be made with a conventional electron microscope is now possible by measuring a lifetime of positrons of a slow positron beam which has entered the substance. Such precise analyses include non-destructive inspection of lattice defects of a semiconductor or metal, and element and structure analyses of the uppermost surface layer of a substance. A slow positron beam can be widely used for the analysis, inspection, and development of various materials, such as for example, semiconductor material and thin film material of transistors and solar batteries, nuclear reactor material, nuclear fusion material, polymer material, and high temperature superconducting material.

A control technique of stably shaping a slow positron beam into an ultra short pulse has been desired in order to precisely measure a lifetime of positrons.

b) Description of the Related Art

FIG. 6 shows a conventional system for shaping a slow positron beam into an ultra short pulse.

Positrons enter a beam duct 50 from the left side as viewed in FIG. 6. The positrons are chopped by a chopper 51 and formed into a pulsatile beam having a time width of about 2 to 30 ns. Prior to bunching the pulsatile beam by a buncher 52, the beam time width is narrowed to 2 ns or less by a sub-harmonics pre-buncher 53.

The sub-harmonics pre-buncher 53 is made of double tubes. A radio frequency (RF) voltage is applied to the inner tube to modulate the beam at two gaps formed at opposite sides of the tube.

The buncher 52 with an RF cavity further modulates the beam and ultimately focusses it on a sample position 54 in the time domain. Not only a sine wave but also its higher harmonics are applied to the buncher 52 in order to enhance the bunching effect. Mikado et al formed an ultra short pulse having a time width of about 150 ps by adding the third harmonic to the fundamental wave (Mikado et al Ionizing Radiation vol.18, No.2 (1992)).

With the conventional technique, a pulse of a charged particle beam having a time width of about 150 ps can be formed. Nevertheless a more stable, compact, and easy to use pulse shaping system has still been desired.

SUMMARY OF THE INVENTION

It is an object of the present invention to provide a technique capable of shaping a charged particle beam having non-relativistic energy into an ultra short pulse.

It is another object of the present invention to provide an inexpensive and small system for bunching a charged particle beam.

According to one aspect of the present invention, there is provided a method of bunching a charged particle beam including the step of generating an electric field during a certain time duration, the electric field being generally parallel to a travelling direction of the charged particle beam having a kinetic energy of 1 eV to 1 MeV, and an intensity of the electric field changing as a quadratic function of time.

In addition to the waveform changing as the quadratic function, a waveform changing linearly may also be used. The linearly changing waveform may be superposed upon a waveform of a half period from phase $\pi$ to $2\pi$ of a sine wave if the linearly changing waveform monotonously increases, or upon a waveform of a half period from phase 0 to $\pi$ of a sine wave if the linearly changing waveform monotonously decreases.

Furthermore, the linearly changing waveform and the sine waveform may be superposed upon a waveform of a half period from phase 0 to $\pi$ of a cosine wave if the linearly changing waveform monotonously increases, or upon a waveform of a half period from phase $\pi$ to $2\pi$ of a cosine wave if the linearly changing waveform monotonously decreases.

According to another aspect of the present invention, there is provided a charged particle beam bunching system comprising: a charged particle beam generator for generating a charged particle beam having a kinetic energy of 1 eV to 1 MeV; a beam duct for receiving the charged particle beam at one end thereof and guiding the charged particle beam in the axial direction of the beam duct, the beam duct having a gap formed along a line intersecting between a virtual plane perpendicular to the axial direction and a side wall of the beam duct; an induction system including a first current path for flowing an RF current via the gap, at least one second current path connected to the first current path; and at least one core for defining a magnetic path linking with the second current path; and voltage applying means for applying a voltage to the induction system, the voltage generating an electric field for bunching the charged particle beam.

By applying an electric field changing as the quadratic function to a charged particle beam, charged particles can be bunched spatially at one point in an ideal case. A linear function may also be used instead of the quadratic function, while retaining an expected bunching effect to some degree. If a sine wave and a cosine wave having suitable waveforms with respect to the phase are superposed on the linearly changing waveform, the resultant waveform is approximate to the quadratic function. Therefore, the bunching effect can be improved further.

An electric field can be generated by the induction system. The induction system can generate the electric field by using one gap formed in the beam duct. Therefore, an additional gap is not necessary and electrical disturbance to be caused by the other gap can be avoided.

As described above, the time width of a pulsatile charged particle beam can be efficiently compressed.

DETAILED DESCRIPTION OF THE PREFERRED EMBODIMENTS

Embodiments of the invention will be described with reference to FIG. 1, by using a slow positron beam bunching system by way of example. This system is applicable not only to positrons but also to other charged particle beams.

Figure 1:
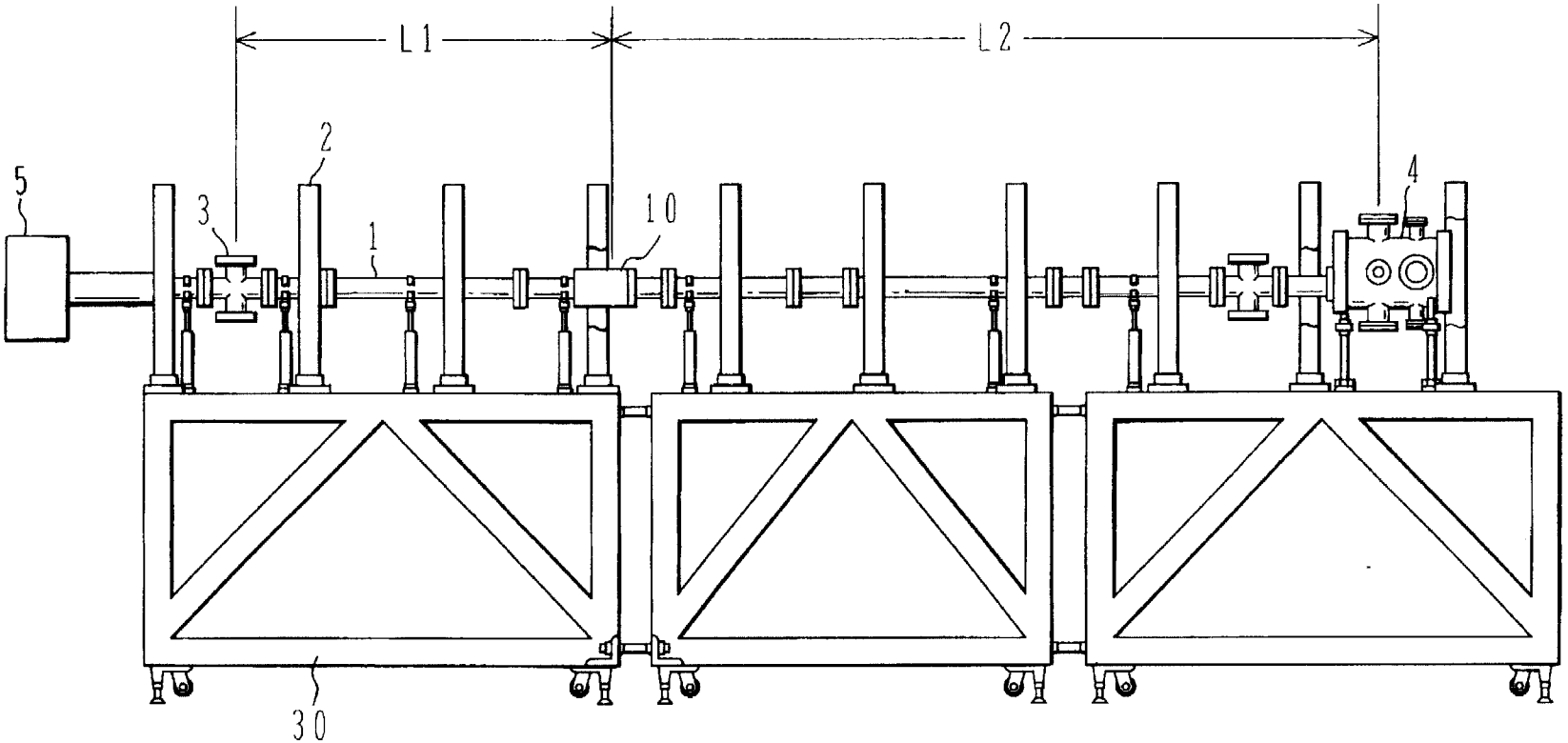
FIG. 1 is a front view of a positron beam bunching system according to an embodiment of the invention.

FIG. 1 is a front view of a positron beam bunching system according to an embodiment of the invention. A cylindrical beam duct 1 is mounted on a support frame 80. A plurality of cylindrical ducts each having flanges at opposite ends thereof are coupled together by the flanges to constitute the beam duct 1. A charged particle beam generator 5 is mounted at the left side of the beam duct 1 as viewed in FIG. 1.

Ten Hermholtz coils 2 are disposed outside of the beam duct 1 coaxial therewith at generally the same pitch. The Hermholtz coils 2 generate a generally uniform beam travelling magnetic field in the beam duct 1 in the axial direction. This beam travelling magnetic field exerts a force perpendicular to the axial direction on charged particles radiated from the charged particle beam generator 5 and entered the beam duct 1 from the left of the beam duct as viewed in FIG. 1. This force gives the charged particles a spiral motion and makes them travel in the axial direction.

A chopper 8 is mounted at the position slightly back from (on the downstream side of) the input port of the beam duct 1. The continuously entering positron beam is chopped by the chopper 3 and shaped in a pulse having a predetermined time width. The chopper 3 may be of a type that generates a pulsatile electric field by using a plurality vane of grids or of a type that chops mechanically.

An induction system 10 is mounted at a distance L1 back from the chopper 3. The induction system 10 will be later in detail with reference to FIG. 2. The positron beam pulsated by the chopper 3 is bunched by the induction system 10 so that the pulse time width is compressed.

A sample chamber 4 for placing a sample is mounted at a distance L2 back from the induction system 10. The positron beam pulsated into an ultra short pulse by the induction system is incident upon the surface of a sample disposed in the sample chamber 4.

The structure and operational principle of the induction system 10 will be described with reference to FIG. 2.

Figure 2:
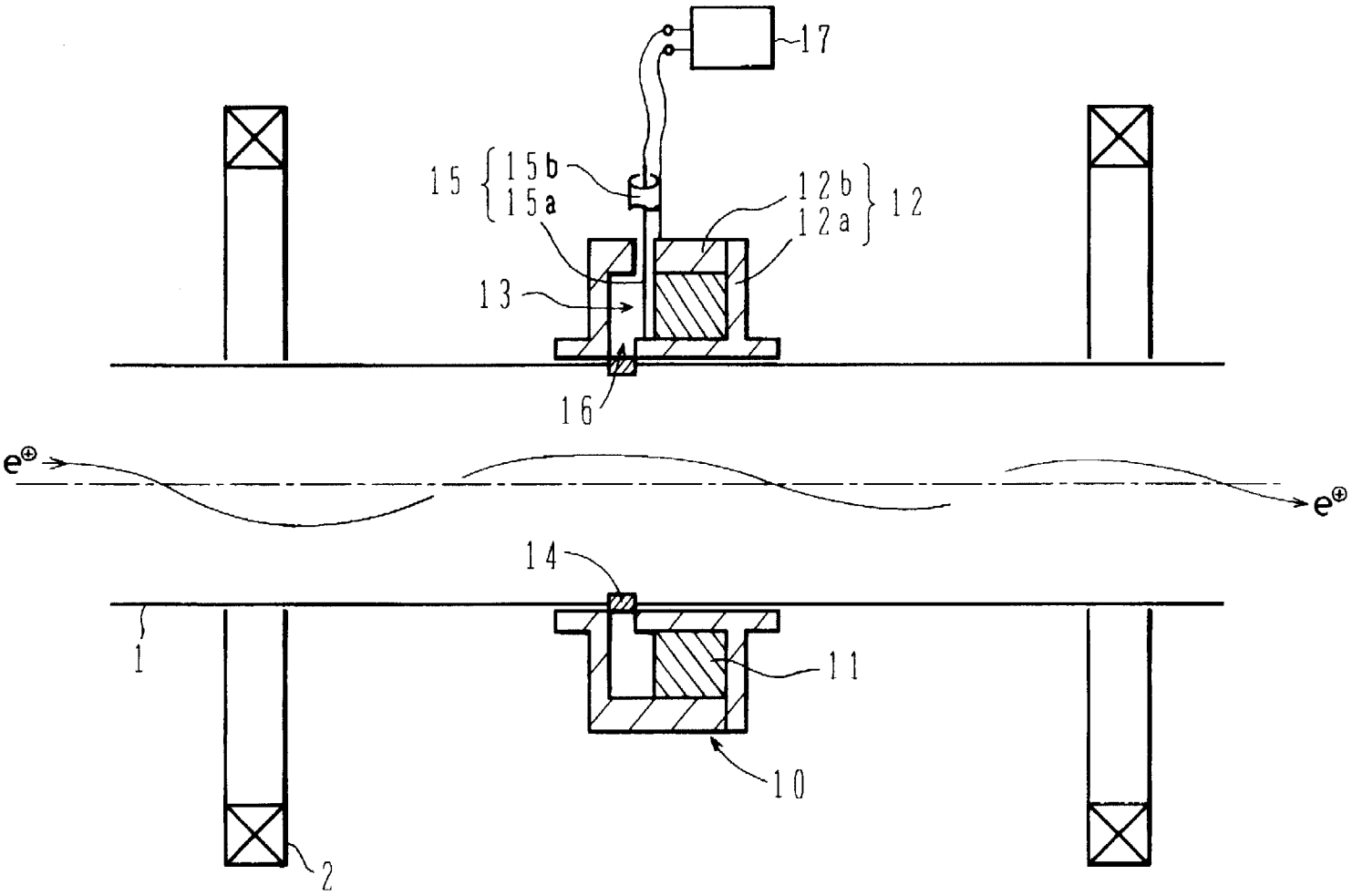
FIG. 2 is a cross sectional view of an induction system of the positron beam bunching system shown in FIG. 1.

FIG. 2 is a cross sectional view taken along a plane inclusive of the center axis of the beam duct 1. A circumferential gap is formed in the side wall of the beam duct 1 at the position where the positron beam is bunched. This gap is filled with a ring member 14 made of insulating material to maintain the inside of the beam duct 1 airtight. The induction system 10 of a ring shape is mounted on the beam duct i while being coupled with the ring member 14.

The induction system 10 comprises a conductive material member 12, a core 11, and a coaxial cable 15. The conductive material member 12 defines a ring space coaxial with the beam duct 1. The core 11 is made of ferromagnetic material and disposed in the ring space. This core 11 defines a closed magnetic path surrounding the outer space of the beam duct 1. The coaxial cable 15 applies a voltage across the conductive member 12. The ring space extends to the ring member 14 via a gap formed in the bottom wall of the conductive member 12. The conductive member 12 is made of an inner member 12*a* and an outer member 12*b*. The inner member 12*a* is in contact with the inner circumference of the core 11 and one side surface thereof. The outer member 12*b* is in contact with the outer circumference of the core 11 and defines a cavity 13 between the other side surface of the core 11 and the inner wall of the outer member 12*b*, the cavity 13 extending to the gap 16.

A core wire 15*a* of the coaxial cable 15 is inserted into the cavity 13 via a through hole formed in the top wall of the outer member 12*b*, and connected to the end portion of the inner member 12*a* on the side of the cavity 13. An outer conductor 15*b* of the coaxial cable 15 is connected to the outer member 12*b* near at its through hole. A voltage generator 17 applies an RF voltage across the core wire 15*a* and outer conductor 15*b* of the coaxial cable 15.

Next, the operation of the induction system 10 will be described with reference to FIG. 5A.

Figure 5A:
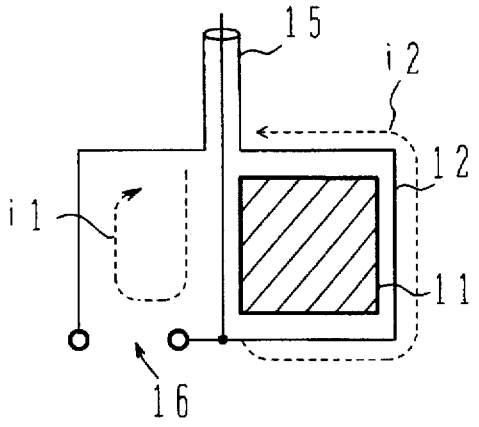
FIGS. 5A to 5D are cross sectional views illustrating electrical interconnections of the induction system shown in FIG. 1 and other induction systems.

FIG. 5A is a schematic diagram showing electrical interconnections of the induction system. The induction system 10 has two current paths i1 and i2, the former flowing an RF current via the gap 16 and the latter linking with the core 11. Since the core 11 is made of ferromagnetic material, the current path i2 has a high inductance. Therefore, if the frequency of the applied voltage is sufficiently high, the impedance of the current path 12 becomes high and current hardly flows.

As the voltage is applied across the coaxial cable 15, current flows through the current path 11 and a potential difference is generated across the gap 16. Therefore, an equipotential plane perpendicular to the axial direction of the beam duct 1 is generated in the beam duct 1. An electric field parallel to the axial direction is therefore generated. This potential difference accelerates or decelerates the charged particles travelling in the beam duct 1, in the axial direction. The time width of the positron beam can be compressed by decelerating the positrons near at the leading edge of the pulsated positron beam and accelerating the positrons near at the trailing edge.

The induction system 10 shown in FIG. 2 is known as an accelerator for a charged particle beam of large current having an acceleration energy of about 10 to 30 MeV. However, it is not known to use such an induction system for the velocity modulation of a non-relativistic charged particle beam.

Figure 6:
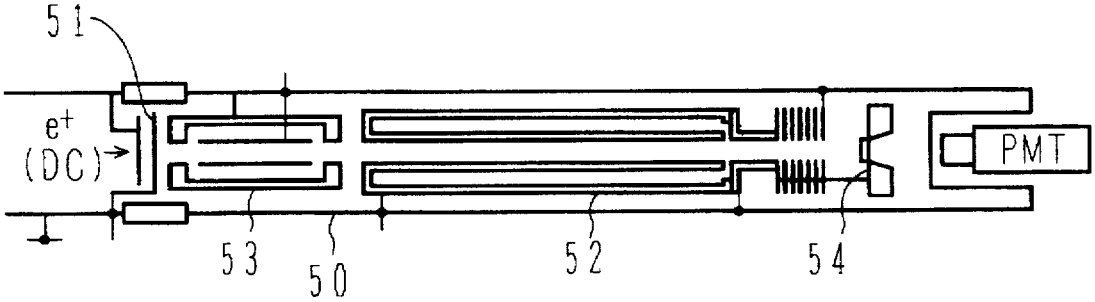
FIG.6 (PRIOR ART)
FIG. 6 is a cross sectional view of a conventional positron beam bunching system.

The conventional bunching system shown in FIG. 6 requires a sub-harmonics pre-buncher for preliminary bunching and an RF cavity for main bunching. The sub-harmonics pre-buncher has two gaps at opposite ends of the cylindrical double conductors. Even if a proper signal is applied to one gap for the preliminary bunching, sufficient preliminary bunching is not possible if the beam is affected at the other gap.

In order to ensure sufficient preliminary bunching by eliminating the influence of the other gap, the length of the cylindrical double conductors is limited. Moreover, unexpected stray capacitance may be generated resulting in a difficulty in assembly in terms of electrical circuits. In contrast, the induction system generates a bunching electric field by using only one gap disposed along the beam duct, and is free from these problems.

Furthermore, since the beam duct can be lowered to an earth potential level at the positions before and after the gap of the induction system, this system is stable relative to external noises.

Next, a waveform of a signal to be applied to the induction system will be described with reference to FIGS. 3A, 3B, and 4A to 4D.

Figure 3A:
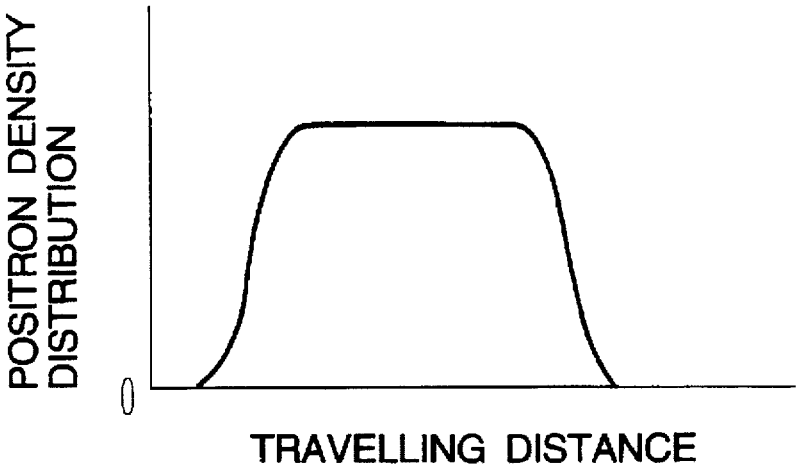
FIG. 3A is a graph showing a spatial distribution of positrons travelling in the beam duct of the positron beam bunching system shown in FIG. 1.

FIG. 3A shows a spatial distribution of positrons of a positron beam travelling in the beam duct. The abscissa represents a travelling distance from a reference point along the center axis of the beam duct, and the ordinate represents a positron density, respectively at an arbitrary scale. If the travelling velocity is constant, the time when the pulsatile beam having positrons distributed along the center axis of the beam duct as shown in FIG. 3A passes a certain point, is proportional to the spatial expansion of positrons distributed along the center axis. It can be considered therefore that the abscissa of FIG. 3A corresponds to the time width of the pulsatile beam.

Ideally, all the positrons passed through the chopper have the same kinetic energy, i.e., the same velocity. Therefore, if positrons are not subjected to an external action, they travel with the beam waveform shown in FIG. 3A being unchanged. The time width of the pulsatile beam can be compressed as it travels, if the positrons near at the leading edge are decelerated and those near at the trailing edge are accelerated.

Figure 3B:
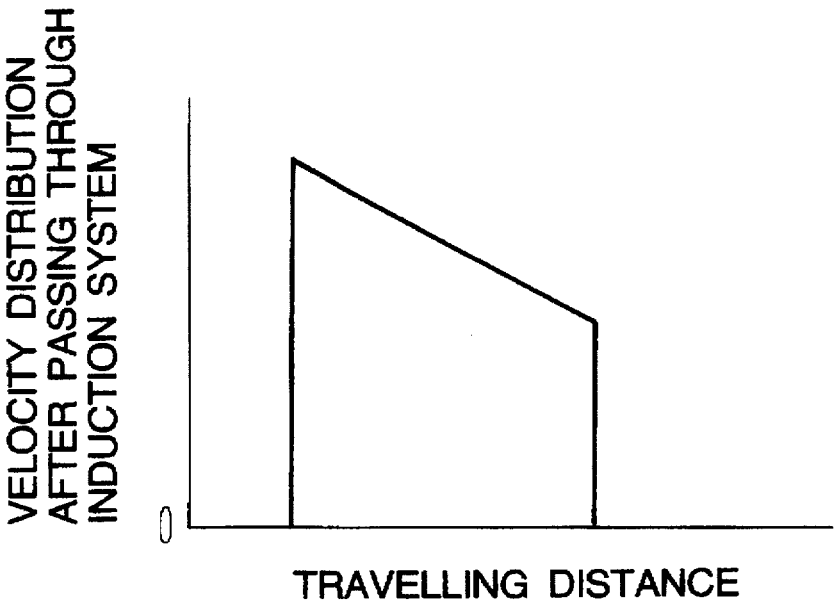
FIG. 3B is a graph showing a velocity distribution of positrons travelling in the beam duct of the positron beam bunching system shown in FIG. 1.

FIG. 3B shows a velocity distribution of positrons after passing the gap of the induction system. The abscissa represents a travelling distance from the reference point, and the ordinate represents a positron velocity, respectively at an arbitrary scale. The velocity of each positron becomes gradually large from the leading edge toward the trailing edge of the pulsatile beam, and changes linearly with the travelling distance. Ideally, as the pulsatile beam having such a velocity distribution travels by a predetermined distance, all the positrons concentrate on a spacial one point.

Next, a method of forming a pulsatile beam having the velocity distribution shown in FIG. 3B will be described. The velocity v of each positron passed the gap is given by the following equation (1), by representing an elementary electric charge by e, an initial positron acceleration voltage by $V_o$, a potential difference of the gap of the induction system by a function V(t) of time t, and a positron mass by $m_e$.

$$v=(2e/m_e)^{1/2}(V_o+V(t))^{1/2}$$
$$=(2eV_o/m_e)^{1/2}(1+V(t)/V_o)^{1/2} \quad (1)$$

If the velocity v is linear with respect to time, the pulsatile beam passed the gap has the velocity distribution shown in FIG. 3B. It is sufficient if $(1+V(t)/V_o)^{1/2}$ in the right side of the equation changes linearly with time t. This can be represented by:

$$(1+V(t)/V_o)^{1/2}=C_1t+C_2 \quad (2)$$

where $C_1$ and $C_2$ are constants. The modification of the equation (2) yields:

$$V(t)=V_oC_1^2t^2+2V_oC_1C_2t+V_oC_2^2-V_o \quad (3)$$

If the boundary condition is assumed to be dV(O)/dt=0, then $C_2$=0. Therefore, the equation (3) is written by:

$$V(t)=V_oC_1^2t^2-V_o \quad (4)$$

The function V(t) is therefore a quadratic function having a positive quadratic coefficient.

Figure 4A:
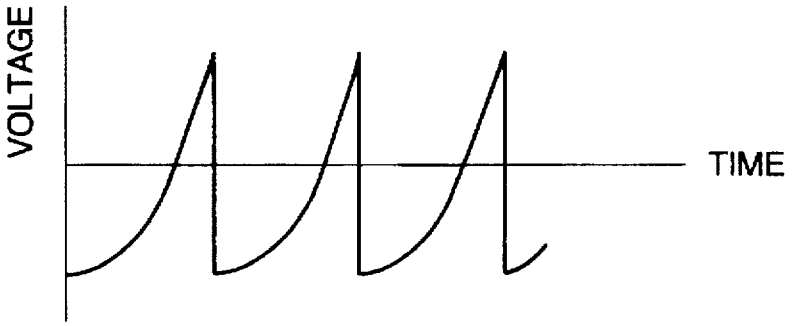
FIGS. 4A to 4D are graphs showing ideal voltage waveforms and embodiment voltage waveforms to be applied to the induction system.

FIG. 4A shows an ideal waveform of the function V(t). If a voltage such as shown in FIG. 4A monotonously increasing its amplitude as a quadratic function of time is periodically applied, the pulsatile positron beam can be efficiently bunched. Although the waveform is shown in FIG. 4A as a continuous wave, the voltage represented by the quadratic function shown in FIG. 4A is applied only when the pulsatile positron beam passes because the positron beam is chopped and travels in a pulsating way.

It is practically difficult to form a voltage waveform changing as the quadratic function, at a low cost and with simple circuitry. It is necessary in practical use to apply a voltage changing as the quadratic function V(t) with the offset $V_o$ being removed. It is difficult to obtain a voltage generator capable of forming such a voltage waveform at a low price and with ease. Accordingly, it is considered that a waveform approximate to that shown in FIG. 4A is formed by combining a linearly changing wave, a sine wave, and a cosine wave.

Figure 4B:
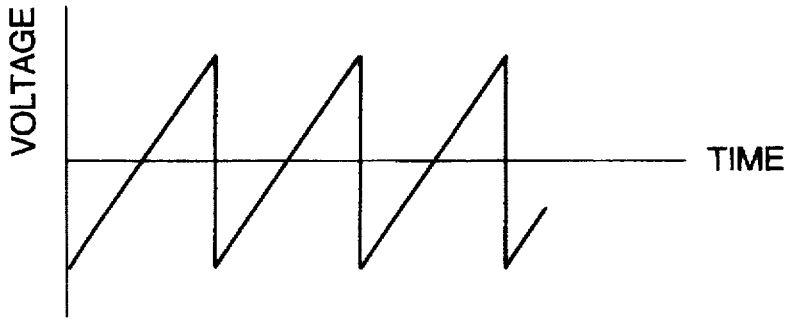

FIG. 4B illustrates approximation by a sawtooth wave. As shown, the voltage increases monotonously and linearly during one period.

Figure 4C:
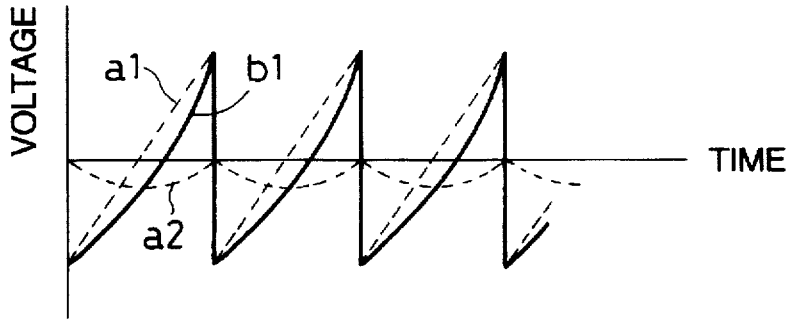

FIG. 4C illustrates superposition of a waveform of a half period of a sine wave from phase π to 2π upon the sawtooth wave shown in FIG. 4B, the superposition being repeated at the same period as that of the sawtooth wave. A broken line a1 shows the sawtooth wave, and another broken line a2 shows the waveform of the sine wave from phase π to 2π. These two waveforms are superposed to form a waveform indicated by a solid line b1 in FIG. 4C. As shown, this waveform is more approximate to the ideal waveform shown in FIG. 4A than the sawtooth wave shown in FIG. 4B.

Figure 4D:
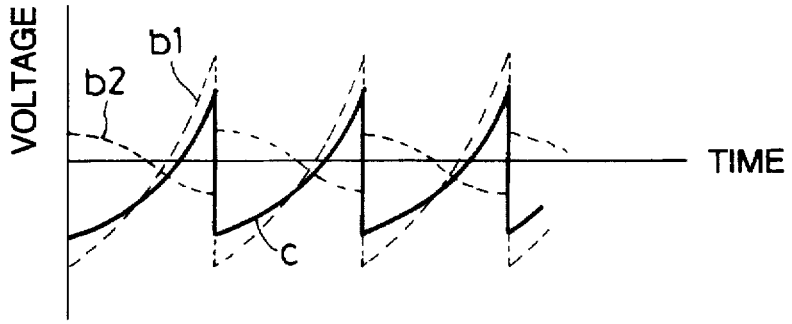

FIG. 4D illustrates superposition of a waveform of a half period of a cosine wave from phase 0 to π upon the sawtooth wave shown in FIG. 4B, the superposition being repeated at the same period as that of the sawtooth wave. A broken line b1 shows the waveform shown in FIG. 4C, and another broken line b2 shows the waveform of the cosine wave from phase 0 to π. These two waveforms are superposed to form a waveform indicated by a solid line c in FIG. 4D. As shown, this waveform is more approximate to the ideal waveform shown in FIG. 4A than the waveform shown in FIG. 4C.

If the charged particles to be bunched are negative charges, the polarities of the voltage waveforms shown in FIGS. 4A to 4D are inverted. Namely, instead of the waveform shown in FIG. 4B, a sawtooth wave of periodically repeated waveforms whose amplitudes reduce monotonously and linearly, is used. The phase of the sine wave to be superposed as in FIG. 4C is set to 0 to π and the phase of the cosine wave to be superposed as in FIG. 4D is set to π to 2π.

The following analysis will clarify that a waveform approximate to a waveform changing as the quadratic function can be formed by superposing sine and cosine waves having proper phases upon a sawtooth wave.

For simplification, assuming that the period of the waveform shown in FIG. 4A is π and the amplitude is "2", the equation (4) is rewritten as:

$$V(t)=(2/\pi^2)t^2-1 \quad (5)$$

This waveform is divided into the sawtooth component and other components. The equation (5) is rewritten as:

$$V(t)=(2/\pi)t-1+[(2/\pi^2)t^2-(2/\pi)t] \quad (6)$$

A sum of the first and second terms of the right side of the equation (6) represents the sawtooth wave. Therefore, the third term in the square brackets of the right side is approximated by a trigonometric function. When function f(t) is defined as:

$$f(t) = 0 \quad (-\pi \leqq t < 0) \tag{7}$$
$$= (2/\pi^2)t^2 - (2/\pi)t \quad (0 \leqq t \leqq \pi)$$

the function f(t) is equal to the third term in the square brackets of the right side of the equation (6), in the range of 0≦ to ≦π. Fourier transformation of the function f(t) yields:

$$f(t) = -\pi^3/6 - (4/\pi)\sin(t) + (2 - 4/\pi)\cos(t) + \tag{8}$$

The equation (8) indicates that the function f(t) can be approximated by a negative sine wave and a positive cosine wave.

It can be understood from the above analysis that a waveform changing as the quadratic function can be approximated by superposing a negative sine wave (sine wave from phase π to 2π) and a cosine wave from phase 0 to π upon the sawtooth wave.

The voltage waveforms shown in FIGS. 4B to 4D were applied to the induction system to bunch positron beams. These experiment results will be described next.

The bunching system shown in FIGS. 1 and 2 was used for the experiments. The core of the induction system used is a Finemetcore (phonetic) (manufactured by Hitachi Metals, Ltd.). The characteristics of the Finemetcore are a high saturation magnetic flux density of 1.3 T or higher and a low magnetostriction.

It is preferable to use material having a high saturation magnetic flux density because the induction system is disposed in the beam travelling magnetic field generated by the Hermholtz coils. The material having a saturation magnetic flux density of 0.5 T or higher is preferably used, and more preferably 1 T or higher. It is also preferable to use material having a low magnetostriction because it is necessary to generate an electric field proportional to an applied voltage. For example, a ferrite core or an amorphous core may be used.

The voltage waveform shown in FIG. 4B was applied to the induction system to bunch a positron beam. The applied sawtooth wave had a waveform changing between −0.275 to +0.275 V at the period of 100 ns. The effective portion of the sawtooth was 80 ns, and the total invalid portion was 20 ns at the front and back regions of the effective portion. The initial energy of the positron beam was 8 eV, the pulse width was 40 ns, and the chopping frequency was 10 MHz. Under these conditions, a pulsatile beam bunched to the time width of 165 ps was obtained at the position 190 cm back from the gap of the induction system.

The voltage waveform shown in FIG. 4C was applied to the induction system to bunch a positron beam, under the conditions that the initial energy was 20 eV, the pulse width was 80 ns, and the chopping frequency was 10 MHz. The sawtooth wave had a waveform changing between −2.05 to +2.05 V at the period of 100 ns (the effective portion of the sawtooth was 80 ns). The sine wave had waveforms from phase π to 2π repeating at the period of 100 ns, and the amplitude thereof was 0.3 V. The sine wave was superposed upon the sawtooth wave by delaying the phase of the sine wave by 1 ns. Under these conditions, a pulsatile beam bunched to the time width of 138 ps was obtained at the position 90 cm back from the gap of the induction system.

The phase of the negative sine wave was delayed in order to compensate for deviations from the ideal conditions, such as that the fall time of the sawtooth wave is not 0 and the gap width of the induction system is not 0. The optimum phase delay is preferably determined from repetitive experiments because each system may have a different optimum phase delay.

The voltage waveform shown in FIG. 4C was used under the different conditions to bunch a positron beam. The initial energy of the positron beam was 200 eV, the pulse width was 30 ns, and the chopping frequency was 10 MHz. The sawtooth wave had a waveform changing between −20 to +20 V at the period of 100 ns (the effective portion of the sawtooth was 30 ns). The negative sine wave had waveforms from phase 0 to π repeating at the period of 100 ns, and the amplitude thereof was 5 V. The negative sine wave and the sawtooth wave were superposed at the same phase.

Under these conditions, a pulsatile beam bunched to the time width of 40 ps was obtained at the position 207 cm back from the gap of the induction system.

The voltage waveform shown in FIG. 4D was applied to the induction system to bunch a positron beam. The positron beam, sawtooth wave, and negative sine wave had the same conditions as the third experiment described above. The cosine wave had waveforms from phase 0 to π repeating at the period of 30 ns, and the amplitude of the cosine wave was 0.1 V. A pulsatile beam bunched to the time width of 20 ps was obtained at the position 207 cm back from the gap of the induction system.

As seen from the experiment results, a pulsatile positron beam can be bunched by applying a sawtooth voltage to the induction system. The bunching efficiency can be improved by superposing a sine wave from phase 0 to 2π (a negative sine wave from phase 0 to π) and in addition a cosine wave from phase 0 to π, upon the sawtooth wave.

In the above experiments, a waveform of a half period of a sine wave or a cosine wave is superposed. A waveform of a half period is not necessarily required. Instead of a half period of a sine wave from phase 0 to π, a portion of the upward-convex waveform of the sine wave may be cut and used. Similarly, instead of a half period of a sine wave from phase π to 2π, a portion of the downward-convex waveform of the sine wave may be cut and used. Instead of a cosine wave from phase 0 to π or from phase π to 2π, a portion of the positive or negative gradient waveform of the cosine wave may be cut and used. In these cases, it is preferable to select a proper waveform from repetitive experiments.

In the above analysis and experiments, a variation of the initial energy of a positron beam does not taken into consideration. The initial energy has a variation in practice. It is preferable to reduce a variation of the initial energy in order to improve the bunching efficiency.

If a pulsatile positron beam chopped by the chopper is made to drift by a predetermined distance, the pulse width is made broad by a variation of the initial energy. If positrons only in the central area of the pulse with the broadened width are bunched, the variation of positrons to be substantially bunched can be made small. Specifically, in the bunching system shown in FIG. 1, the distance L1 between the chopper 3 and the gap of the induction system is secured.

The distance L1 was set to 100 cm and a pulsatile positron beam was bunched. The initial energy of the positron beam was 8 eV, the energy variation was +/−0.5 eV, and the time width immediately after chopping was 30 ns. A waveform of a voltage applied to the induction system was a positive sine wave superposed on a sawtooth wave. A pulsatile beam bunched to a half value width of 200 ps was obtained at the position 206 cm back from the gap of the induction system.

In this experiment, the distance L1 was set to 100 cm. Other proper distances may be secured. The distance L1 is preferably selected depending upon the breadth of energy. The distance of about 10 to 200 cm may be preferable from the practical viewpoint.

In FIGS. 2 and 5A, two current paths of the induction system 10 are connected in parallel. The two current paths may be connected in series. Furthermore, a plurality of cores may be used.

Figure 5B:
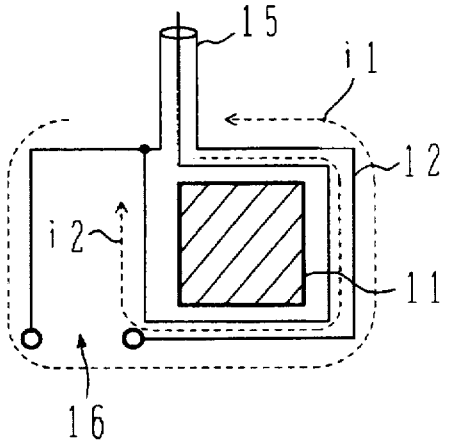

FIG. 5B illustrates the case where two current paths of the induction system 10 are configured to flow current serially through the two current paths. In the configuration shown in FIG. 5B, the core wire of the coaxial cable 15 surrounds the core 11. As an Rf current flows through the current path i2 of the core wire, current flows through the current path i1 formed by the conductive member 12 and the gap 16 so that a change in the magnetic field in the core 11 can be cancelled. This current generates a potential difference between the opposite ends of the gap.

Figure 5C:
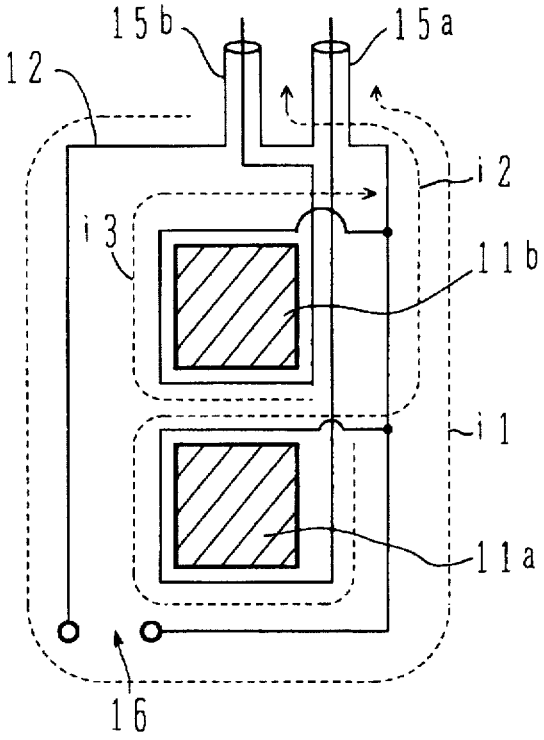

FIG. 5C illustrates the case where cores 11*a* and 11*b* and coaxial cables 15*a* and 15*b* are used and the core wires of the coaxial cables 15*a* and 15*b* are respectively wound about the cores 11*a* and 11*b*. The core wire of the coaxial cable 15*a* forms a current path i2. Current flows through the current circuit i2 to the outer conductor of the coaxial cable 15*b*.

Current flowing through the current path i3 formed by the core wire of the coaxial cable 15*b* flows through the current path i1 formed by the conductive member 12 and the gap 16 to the outer conductor of the coaxial cable 15*a*.

Current flows in opposite directions through the current paths i2 and i3 at the areas between the cores 11*a* and 11*b*. This is equivalent to that substantially no current flows. Therefore, a change in the magnetic fields in the cores 11*a* and 11*b* is cancelled by the current flowing through the current paths i2 and i3 and the current flowing through the current path i1.

Figure 5D:
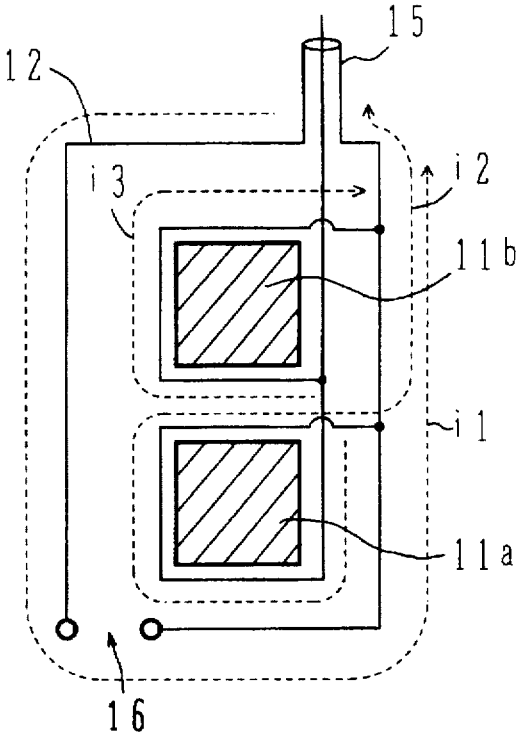

FIG. 5D illustrates the case where a core wire of a single coaxial cable is wound in parallel about two cores 11*a* and 11*b*. Current paths i1 to i3 similar to FIG. 5C are formed. Current flowing through the current path i1 generates a potential difference between the opposite ends of the gap 16.

The circuit shown in FIG. 5B is characterized in that an inductance becomes larger by eddy current than the circuit shown in FIG. 5A. The other fundamental characteristics of both the circuits are the same.

With the circuit shown in FIG. 5C, different signals can be inputted via the two coaxial cables so that a variety of electric fields can be generated by the gap 16.

The circuit shown in FIG. 5D is effective for the case where an amplitude of an input voltage cannot be made large, for example, for the case where a maximum output voltage of input amplifier is insufficient.

The present invention has been described in connection with the preferred embodiments. The invention is not limited only to the above embodiments, and it should be apparent to those skilled in the art that various modifications, improvements, combinations and the like can be made without departing from the scope of the appended claims.

We claim:

1. A method of bunching a non-relativistic charged particle beam having a kinetic energy of 1 eV to 1 MeV comprising generating an electric field during a certain time duration, said electric field being generally parallel to a travelling direction of the charged particle beam, and an intensity of said electric field changing as a quadratic function of time.

2. A method of bunching a non-relativistic charged particle beam having a kinetic energy of 1 eV to 1 MeV according to claim 1, further comprising the step of chopping said charged particle beam to form a pulsatile charged particle beam, prior to generating said electric field.

3. A method of bunching a non-relativistic charged particle beam having a kinetic energy of 1 eV to 1 MeV according to claim 2, further comprising moving said pulsatile charged particle beam by a distance of 10 to 200 cm in the travelling direction of the charged particle beam, after forming said pulsatile charged particle beam and before generating said electric field.

4. A method of bunching a non-relativistic charged particle beam having a kinetic energy of 1 eV to 1 MeV comprising generating a first electric field during a certain time duration, said first electric field being generally parallel to a travelling direction of the charged particle beam, and an intensity of said first electric field changing linearly with time.

5. A method of bunching a non-relativistic charged particle beam having a kinetic energy of 1 eV to 1 MeV according to claim 4, wherein a second electric field is superposed during the certain time duration on said first electric field, and said second electric field changes with time in correspondence with: (i) a downward-convex waveform of a sine wave if the intensity of said first electric field monotonously increases during the certain time duration, and (ii) an upward-convex waveform of a sine wave if the intensity of said first electric field monotonously decreases during the certain time duration.

6. A method of bunching a non-relativistic charged particle beam having a kinetic energy of 1 eV to 1 MeV according to claim 5, wherein said downward-convex waveform comprises a waveform of a half period from phase $\pi$ to $2\pi$ of a sine wave, and said upward-convex waveform comprises a waveform of a half period from phase 0 to $\pi$ of a sine wave.

7. A method of bunching a non-relativistic charged particle beam having a kinetic energy of 1 eV to 1 MeV according to claim 6, wherein phases of said first and second electric fields are shifted from each other.

8. A method of bunching a non-relativistic charged particle beam having a kinetic energy of 1 eV to 1 MeV according to claim 5, wherein a third electric field is superposed during the certain time duration on said first and second electric fields, and said third electric field changes with time in correspondence with: (i) a negative gradient waveform of a cosine wave if the intensity of said first electric field monotonously increases during the certain time duration, and (ii) a positive gradient waveform of a cosine wave if the intensity of said first electric field monotonously decreases during the certain time duration.

9. A method of bunching a non-relativistic charged particle beam having a kinetic energy of 1 eV to 1 MeV according to claim 8, wherein said negative gradient waveform comprises a waveform of a half period from phase 0 to $\pi$ of a cosine wave, and said positive gradient waveform comprises a waveform of a half period from phase $\pi$ to $2\pi$ of a cosine wave.

10. A non-relativistic charged particle beam bunching system comprising:

a charged particle beam generator for generating a non-relativistic charged particle beam having a kinetic energy of 1 eV to 1 MeV;

a beam duct for receiving said charged particle beam at one end thereof and guiding said charged particle beam in an axial direction of said beam duct, said beam duct having a gap formed along a line intersecting between a virtual plane perpendicular to the axial direction of said beam duct and a side wall of said beam duct;

an induction system including a first current path for flowing an RF current via said gap, at least one second current path connected to said first current path, and at least one core for defining a magnetic path linking with said second current path; and a voltage generator for applying a voltage to said induction system so as to generate an electric field for bunching said charged particle beam.

11. A non-relativistic charged particle beam bunching system according to claim 10, wherein said voltage generator applies said voltage during a certain time duration, and said voltage changes as a quadratic function of time.

12. A non-relativistic charged particle beam bunching system according to claim 10, wherein said voltage generator applies a first voltage during a certain time duration, and said first voltage changes linearly with time.

13. A non-relativistic charged particle beam bunching system according to claim 12, wherein said voltage generator applies a second voltage during the certain time duration which is superposed on said first voltage, and said second voltage changes with time in correspondence with: (i) a downward-convex waveform of a sine wave if said first voltage monotonously increases during the certain time duration, and (ii) an upward-convex waveform of a sine wave if said first voltage monotonously decreases during the certain time duration.

14. A non-relativistic charged particle beam bunching system according to claim 13, wherein said downward-convex waveform comprises a waveform of a half period from phase $\pi$ to $2\pi$ of a sine wave, and said upward-convex waveform comprises a waveform of a half period from phase 0 to $\pi$ of a sine wave.

15. A non-relativistic charged particle beam bunching system according to claim 14, wherein phases of said first and second voltages are shifted from each other.

16. A non-relativistic charged particle beam bunching system according to claim 14, wherein said voltage generator applies a third voltage during the certain time duration which is superposed on said first and second voltages, and said third voltage changes with time in correspondence with: a negative gradient waveform of a cosine wave if said first voltage monotonously increases during the certain time duration, and (ii) a positive gradient waveform of a cosine wave if said first voltage monotonously decreases during the certain time duration.

17. A non-relativistic charged particle beam bunching system according to claim 16, wherein said negative gradient waveform comprises a waveform of a half period from phase 0 to $\pi$ of a cosine wave, and said positive gradient waveform comprises a waveform of a half period from phase $\pi$ to $2\pi$ of a cosine wave.

18. A non-relativistic charged particle beam bunching system according to claim 10, wherein said first and second current paths of said induction system are connected to each other in parallel.

19. A non-relativistic charged particle beam bunching system according to claim 10, wherein said first and second current paths of said induction system are configured so as to serially flow current through said first and second current paths.

20. A non-relativistic charged particle beam bunching system according to claim 10, wherein said second current path of said induction system includes a plurality of current paths, and said voltage generator is provided in correspondence with each of the plurality of current paths of said second current path.

21. A non-relativistic charged particle beam bunching system according to claim 10, further comprising a chopper for chopping said non-relativistic charged particle beam to form a pulsatile charged particle beam, said chopper being disposed at an upstream position of said gap in said beam duct along a travelling path of said charged particle beam.

22. A non-relativistic charged particle beam bunching system according to claim 21, wherein said chopper and said gap are spaced apart by a distance of 10 to 200 cm.

23. A non-relativistic charged particle beam bunching system according to claim 10, wherein a saturation magnetic flux density of said core of said induction system is at least 0.5 T.

* * * * *